US012486760B2

(12) United States Patent
Chace et al.

(10) Patent No.: US 12,486,760 B2
(45) Date of Patent: Dec. 2, 2025

(54) METHOD AND APPARATUS FOR EVALUATING THE EXPANSION OF SHAPE MEMORY POLYMER IN WELL COMPLETIONS

(71) Applicant: Baker Hughes Oilfield Operations LLC, Houston, TX (US)

(72) Inventors: David Chace, Spring, TX (US); Feyzi Inanc, Spring, TX (US); Ian Oliver McGlynn, Houston, TX (US); Emmannuel David Soans, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 209 days.

(21) Appl. No.: 18/356,784

(22) Filed: Jul. 21, 2023

(65) Prior Publication Data

US 2025/0027405 A1 Jan. 23, 2025

(51) Int. Cl.
*E21B 33/12* (2006.01)
*E21B 33/128* (2006.01)
(Continued)

(52) U.S. Cl.
CPC ..... *E21B 47/111* (2020.05); *E21B 33/128* (2013.01); *E21B 47/005* (2020.05)

(58) Field of Classification Search
CPC ..... E21B 33/128; E21B 47/005; E21B 47/111
See application file for complete search history.

(56) References Cited

U.S. PATENT DOCUMENTS 9,163,474 B2 * 10/2015 Ramon ..... E21B 33/12
10,570,330 B2 * 2/2020 Shojaei ..... C09K 8/508
(Continued)

FOREIGN PATENT DOCUMENTS

WO WO-2009045656 A1 * 4/2009 ..... C08G 18/44
WO WO-2011133369 A1 * 10/2011 ..... E21B 29/10
(Continued)

OTHER PUBLICATIONS

Fai Auto, "Viscous Vibration Dampers", https://www.faiauto.com/viscous-vibration-dampers/, retrieved Nov. 5, 2024, 5 pages.
(Continued)

*Primary Examiner* — Mark R Gaworecki
(74) *Attorney, Agent, or Firm* — CANTOR COLBURN LLP

(57) ABSTRACT

A downhole system for evaluating an expansion of a shape memory material (SMM) in a borehole. The SMM expands into an annulus between a work string and an annulus. A pulsed neutron gamma ray tool irradiates the borehole and formation with neutrons and detects gamma rays generated from the borehole in response to the irradiation. A processor receives inelastic gamma ray measurements and capture gamma ray measurements based on irradiating the borehole at a first location within the borehole after the SMM has been expanded into the annulus at the first location, estimates a ratio of a first quantity including at least the inelastic gamma ray measurements to a second quantity including the capture gamma ray measurements, at the location, and evaluates a degree to which the SMM has filled the borehole at the location based on a relation between the ratio measurement and a selected range.

13 Claims, 6 Drawing Sheets

(51) Int. Cl.

| | |
|---|---|
| ***E21B 47/00*** | (2012.01) |
| ***E21B 47/005*** | (2012.01) |
| ***E21B 47/11*** | (2012.01) |

(56) References Cited

U.S. PATENT DOCUMENTS

| | | | | |
|---|---|---|---|---|
| 2007/0125532 | A1* | 6/2007 | Murray | E21B 33/1216 166/179 |
| 2007/0240877 | A1* | 10/2007 | O'Malley | E21B 36/00 166/387 |
| 2010/0212891 | A1 | 8/2010 | Stewart et al. | |
| 2011/0168386 | A1 | 7/2011 | Green et al. | |
| 2017/0138187 | A1 | 5/2017 | Moronkeji et al. | |
| 2018/0136361 | A1 | 5/2018 | Jacobson et al. | |
| 2019/0178076 | A1 | 6/2019 | Hinkie et al. | |

FOREIGN PATENT DOCUMENTS

| | | | | |
|---|---|---|---|---|
| WO | WO-2016089526 | A1 * | 6/2016 | E21B 23/00 |
| WO | WO-2022198176 | A1 * | 9/2022 | E21B 19/14 |
| WO | WO-2025014848 | A1 * | 1/2025 | E21B 33/1208 |

OTHER PUBLICATIONS

Flores, et al., "Acoustic and Nuclear Wireline Logging Validation of Shape Memory PolymerScreen Expansion"; SPE Paper No. 196047-MS; Sep. 30, 2019; 19 pages.

G. Bourgois, "Dual Mass Flywheel for Torsional Vibrations Damping: Parametric study for applicaiton in heavy vehicle", Chalmers University of Technology Department of Applied Mechanics, 2016, 104 pages.

International Search Report & Written Opinion in International Application No. PCT/US24/38715, mailed Oct. 24, 2024; 7 pages.

* cited by examiner

METHOD AND APPARATUS FOR EVALUATING THE EXPANSION OF SHAPE MEMORY POLYMER IN WELL COMPLETIONS

BACKGROUND

In the resource recovery industry, a completion operation is used to seal a borehole in a formation in order to produce hydrocarbons from the formation. Some completion operations are performed using a shape memory material (SMM) to install a permeable porous medium in an annular space between a liner and a formation to provide mechanical support to the formation and to reduce or eliminate the migration of uncemented sand grains into the wellbore during production. The SMM is conveyed downhole on a tubular element to a selected location and is then expanded to seal the borehole. If the SMM does not effectively or completely fill the annular space, a subsequent operation, such as a production operation, can be compromised. Therefore, there is a need to evaluate the integrity of an SMM installation in the borehole.

SUMMARY

In one aspect, disclosed herein is a method of evaluating an expansion of a shape memory material (SMM) in a borehole. The method includes expanding the SMM into the borehole at a first location, obtaining inelastic gamma ray measurements and capture gamma ray measurements from the borehole at the first location using a pulsed neutron gamma ray tool, estimating a ratio of a first quantity including at least the inelastic gamma ray measurements to a second quantity including the capture gamma ray measurements, at the location, and evaluating a degree to which the SMM has filled the borehole at the location based on a relation between the ratio measurement and a selected range.

In another aspect, disclosed herein is a downhole system. The downhole system includes a work string forming an annulus with a borehole, a shape memory material (SMM) configured to expand into the annulus, a pulsed neutron gamma ray tool configured to irradiate the borehole and formation with neutrons and detect gamma rays generated from the borehole in response to the irradiation, and a processor. The processor is configured to receive inelastic gamma ray measurements and capture gamma ray measurements based on irradiating the borehole at a first location within the borehole after the SMM has been expanded into the annulus at the first location, estimate a ratio of a first quantity including at least the inelastic gamma ray measurements to a second quantity including the capture gamma ray measurements, at the location, and evaluate a degree to which the SMM has filled the borehole at the location based on a relation between the ratio measurement and a selected range.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
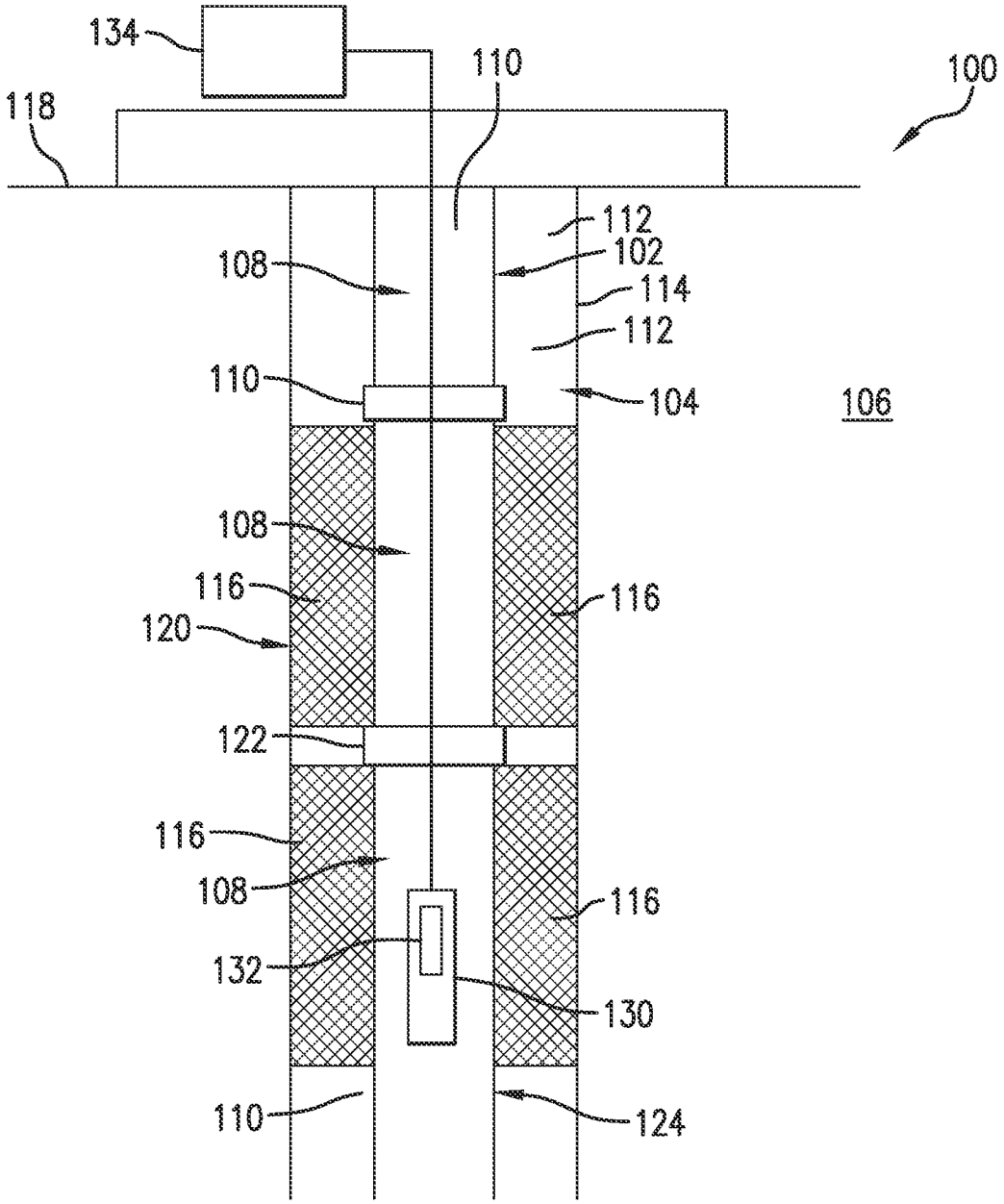
FIG. 1 shows a downhole system in an illustrative embodiment.

Referring to FIG. 1, a downhole system 100 is shown in an illustrative embodiment. In various embodiments, the downhole system 100 is a completion system. The downhole system 100 includes a work string 102 disposed within a borehole 104 formed in a formation 106. The work string 102 includes one or more tubulars 108 having various devices thereon that can be employed to perform the completion operation. A tubular 108 has an inner bore 110 and forms an annulus 112 between its outer surface and a wall 114 of the borehole 104. During a completion operation, the annulus 112 is completed using a concentric sleeve made of a shape memory material (SMM) 116, such as a shape memory polymer. The SMM 116 is a material that can change its form upon an external stimulus, such as upon experiencing a change in temperature and/or saturation with an activation fluid, which is generally performed via injection of an activation fluid in the borehole 104. For the purposes of a completion, the SMM 116 is placed on the tubular 108 while in a compressed state when the tubular is at a surface location 118 and at a first temperature. The tubular 108 is run into the borehole 104, thereby placing the SMM 116 into an environment having a second temperature. The activation fluid can then be injected into the borehole to come into contact with the SMM 116, causing the SMM 116 to expand into the annulus 112. Ideally, the SMM 116 expands to completely fill the annulus 112. However, in some cases, the SMM 116 may expand to only partially fill the annulus 112. The methods disclosed herein evaluate a degree to which the SMM 116 fills the annulus 112 and provides information that allows performance of a subsequent action based on the evaluation (if needed). The degree to which the SMM 116 fills the annulus 112 can be expressed as a percentage, such as a percentage of volume.

As shown in FIG. 1, the SMM 116 is expanded at a first location 120 of the borehole 104. The work string 102 includes a collar 122 that connects tubulars 108 as required. depending on the length of an interval of the borehole 104. The work string 102 can further includes a second location 124 at which no SMM is present. The annular dimensions of the borehole at the second location 124 is substantially the same as the annular dimensions of the first location 120 and can be used as an in-situ reference point.

A pulsed neutron (PN) gamma ray measurement tool 130 is disposed in the inner bore 110 of the tubular 108 and can be run along an axis of the tubular 108 to any selected location, such as at the first location 120 and the second location 124. The PN gamma ray measurement tool 130 is used to measure various types of gamma rays emitted by nuclei in the borehole, formation and/or fluids in response to neutrons generated by a pulsed neutron source.

The PN gamma ray measurement tool 130 can include a downhole processor 132 that can be used to process PN gamma ray measurements used to evaluate an expansion of the SMM 116 in the borehole 104. The downhole processor 132 can be in communication with a surface processor 134. At least one of the downhole processor 132 and the surface processor 134 can be used to evaluate the SMM expansion to determine a subsequent operation to be performed. For example, if the SMM expansion is determined to be incomplete or partial at a given location, a remedial action may be taken to fix the SMM, fill any unfilled space, etc. This may, for example, be done by injection of additional activation fluid. If the SMM expansion is determined to be complete (i.e., most or all space is filled by the expansion at the location), subsequent operations, such as a production operation, can be performed.

Figure 2:
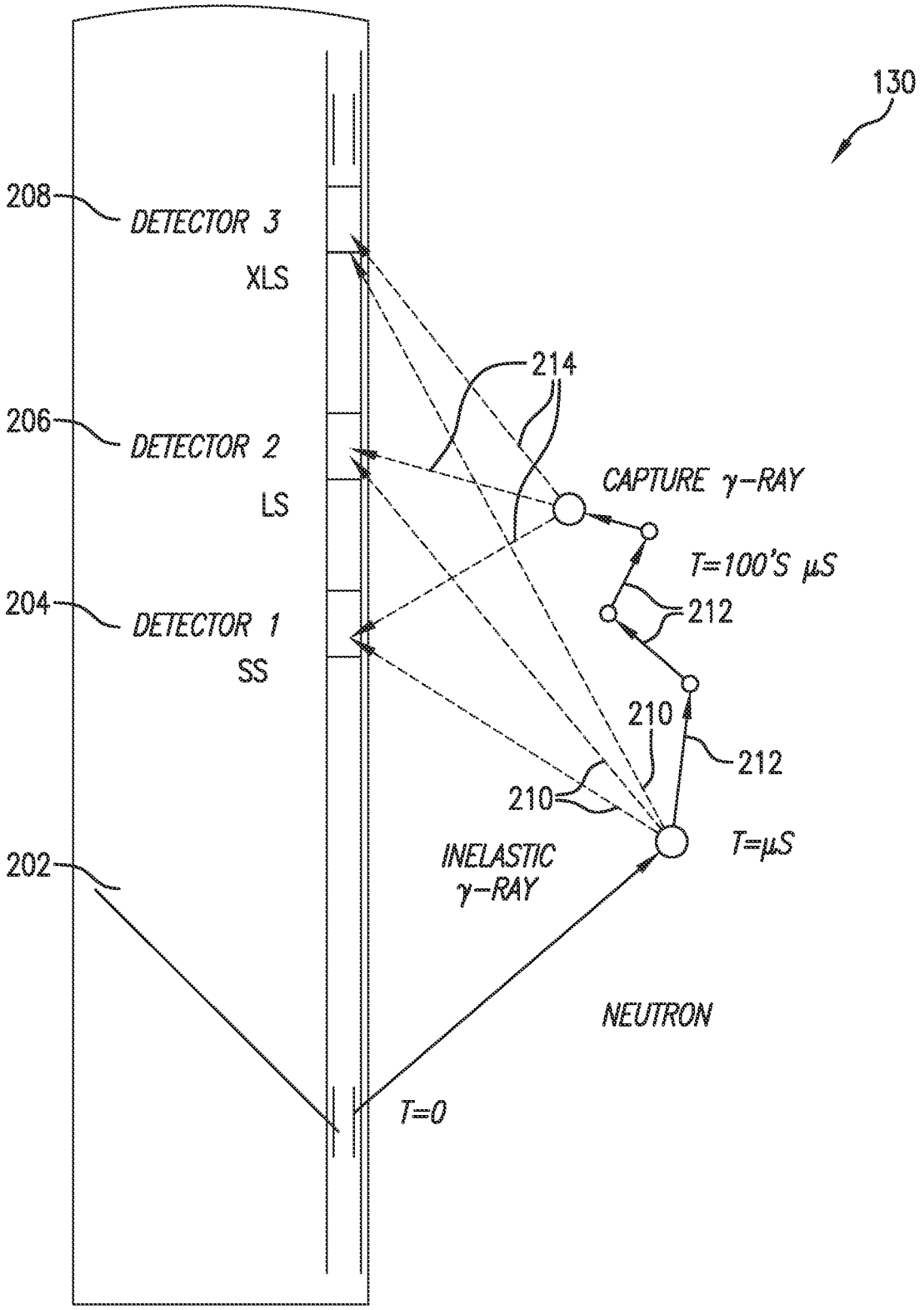
FIG. 2 shows an illustration of a gamma ray measurement tool suitable for use with the downhole system, in an illustrative embodiment.

FIG. 2 shows an illustration of a PN gamma ray measurement tool 130 suitable for use with the present invention, in an illustrative embodiment. The PN gamma ray measurement tool 130 includes a pulsed neutron source 202 and three axially spaced apart detectors described below: a short-spaced detector (SS detector 204), a long-spaced detector (LS detector 206) and an extra-long spaced detector (XLS detector 208). The SS detector 204 is closest to the pulsed neutron source 202, with the LS detector 206 next farthest from the pulsed neutron source 202 and the XLS detector 208 being the farthest away from the pulsed neutron source 202. It is understood that the number of detectors shown in the PN gamma ray measurement tool 130 is only an example of the number of possible detectors that can be employed and is not a limitation on the scope of the present invention. The PN gamma ray measurement tool 130 may therefore include one or more detectors in various embodiments.

The pulsed neutron source 202 emits pulses of fast neutrons (approximately 14.2 MeV) into the borehole 104 and/or formation, where they undergo several types of interactions. The pulsed neutron source 202 can also be pulsed at different frequencies and modes for different types of measurements. During and in the first few microseconds (μs) after a neutron pulse or burst, before significant energy loss occurs, the neutrons are involved in inelastic scattering with nuclei in the borehole 104, formation and/or fluids and produce gamma rays, referred to as inelastic gamma rays 210. These inelastic gamma rays 210 have energies that are characteristic of the atomic nuclei that produce them. The atomic nuclei found in this environment include, for example, carbon, oxygen, silicon, calcium, and some others.

After a few μs, most of the neutrons are slowed by either inelastic or elastic scattering until they reach thermal energies, about 0.025 eV. This process is illustrated schematically in FIG. 2 as a sequence of solid arrows 212. At thermal energies, neutrons continue to undergo elastic collisions, but they no longer lose energy on average. A few us after the pulsed neutron source 202 shuts off, the process of thermalization is complete. Over the next several hundred μs, thermal neutrons can be captured by nuclei of various elements, thereby producing gamma rays known as capture gamma rays 214.

The gamma rays can be detected at the one or more detectors and used to form ratios that indicate the state of the expansion of the SMM 116 in the annulus. The ratio compares a first quantity that includes at least the inelastic gamma ray measurements to a second quantity that includes the capture rays measurements. For example, a ratio (RICS) of inelastic gamma rays to capture gamma rays can be measured at the SS detector 204. In another embodiment, a ratio (RTCS) is a ratio of total gamma rays to capture gamma rays. These measurements are in part dependent on hydrogen concentration.

Returning to FIG. 1, when in the compressed state, the SMM 116 has a porosity of about 50% and displaces water away from the tubular 108 toward the wall 114 of the borehole 104. When the SMM 116 is in an expanded state, the porosity increases to about 85% and allows water or fluid to fill in the pore space of the SMM 116, closer to the PN gamma ray measurement tool. In addition, as the SMM expands the completion is centralized in the borehole, moving farther away from the formation/borehole wall. This SMM expansion increases the amount of fluid that is close to the PN gamma ray measurement tool. As a result, the pulsed neutron measurements can be used to indicate a increase in the presence of fluid near the PN gamma ray measurement tool 130 after expansion of the SMM 116.

Figure 3:
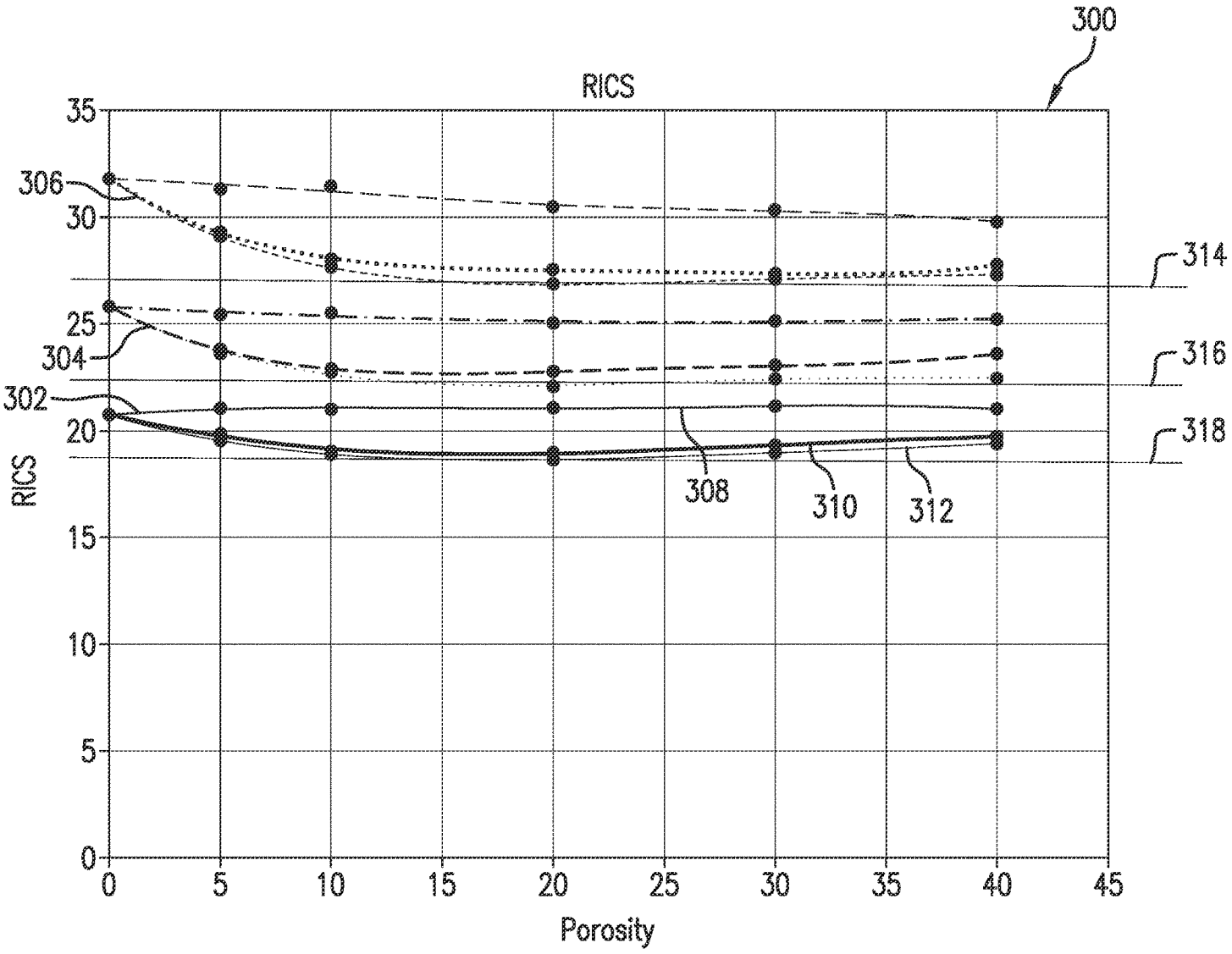
FIG. 3 shows a graph of modeled RICS (ratio of inelastic gamma rays to capture gamma rays) responses.

FIG. 3 shows a graph 300 of modeled RICS responses for three different borehole conditions. Porosity is shown along the abscissa and ratio is shown along the ordinate axis. A first set 302 of modeled RICS responses predicts measurements made by the PN gamma ray measurement tool 130 for a compressed SMM in a borehole filled with oil-based mud. A second set 304 of modeled RICS responses predicts measurements made by the PN gamma ray measurement tool 130 for a compressed SMM in a borehole filled with water. A third set 306 of modeled RICS responses predicts measurements made by the PN gamma ray measurement tool 130 for an expanded SMM 116 in water. As illustrated in the first set 302 of modeled RICS responses, a first RICS response 308 is obtained with respect to a gas filled formation, a second RICS response 310 is obtained with respect to a water filled formation and a third RICS response 312 is obtained with respect to an oil filled formation. Responses are similar for the second set 304 and the third set 306. The curves of the third set 306 are entirely distinguishable from the curves to the second set 304 and of the first set 302, with no overlapping between curves from different sets. Thus, it is possible to set a non-ambiguous range of RICS values which are indicative of the SMM 116 being in an expanded state (rather than a compressed state). The range of RICS values can be determined from by prior testing, simulation, Monte Carlo modeling (such as a Monte Carlo N-Particle modeling) or using in-situ reference measurements. An illustrative range is shown by its lower limit 318, a mid-range value 316 its upper limit 314, corresponding to the various stages of installation and expansion in an oil-filled reservoir (similarly, values for a water-filled, gas-filled or multi-phase filled reservoirs can be assigned based on the formation saturation and predicted responses). The ranges can be predicted using modeling for a particular composition, size, and fluid density to predict pulsed neutron tool responses. Evaluation of the expansion of the SMM 116 can be performed using PN gamma ray measurements obtained after the expansion of the SMM has occurred. When the RICS measurement is within the specified range, the expansion made by the SMM is considered to be complete and production steps can be performed. When the RICS measurement is outside of this range (e.g., below the range), the expansion is considered to be incomplete and remedial action can be taken to fix or repair or improve expansion of the SMM 116. While FIG. 3 is a graph of RICS, similarly graphs can be formed for other measurement ratios, including RTCS.

Figure 4:
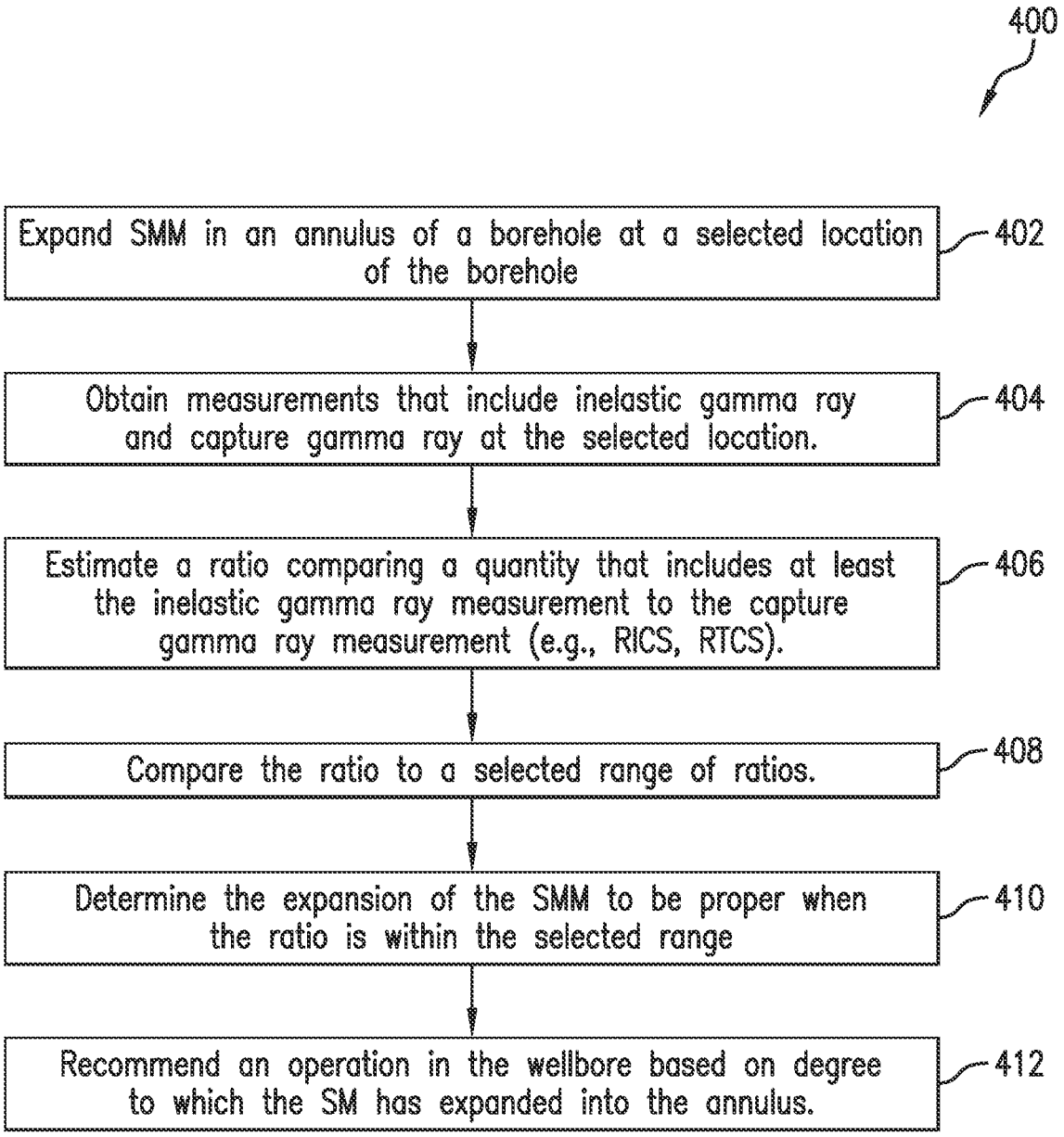
FIG. 4 shows a flowchart of a method of determining a quality or degree of a shape memory material expansion in an annulus of a borehole.

FIG. 4 shows a flowchart 400 of a method of determining a quality or degree of the SMM expansion in the borehole. In box 402, the SMM is expanded in the annulus 112 of the borehole 104 at a selected location or depth of the borehole 104. In box 404, PN gamma ray measurements are obtained at the selected location after the SMM has been expanded. The PN gamma ray measurements include measurements of inelastic gamma rays 210 and capture gamma rays 214. The measurements are generally omni-directional measurements that see a volume of completion and of formation, but which are most affected by measurements from the annulus space (e.g., most inelastic gamma rays are created closer to the PN instrument than are capture gamma rays and are therefore more sensitive to borehole effects). In box 406, a ratio (e.g., RICS, RTCS) is determined for the selected location from the inelastic PN gamma ray measurements and the capture PN gamma ray measurements. In box 408, the ratio (e.g., RICS, RTCS) is compared to a selected range of ratios.

In box 408, the seal made by the SMM is evaluated based on the comparison. The expansion of the SMM into the annulus 112 is determined to fill the annulus completely or greater than a threshold amount when the RICS (or RTCS) is within the selected range. In box 410, a processor provides an evaluation of the SMM expansion that can be used to perform an operation in the borehole. If the evaluation indicates that the SMM has expanded into the annulus 112 by an amount that meets or exceeds a criterion, subsequent operations can be performed, such as production operations. If the evaluation indicates that the SMM has not expanded into the annulus 112 by an amount that meets the criterion, remedial action can be taken to fill in spaces in the annulus 112 that are left vacant by incomplete expansion of the SMM.

Figure 5:
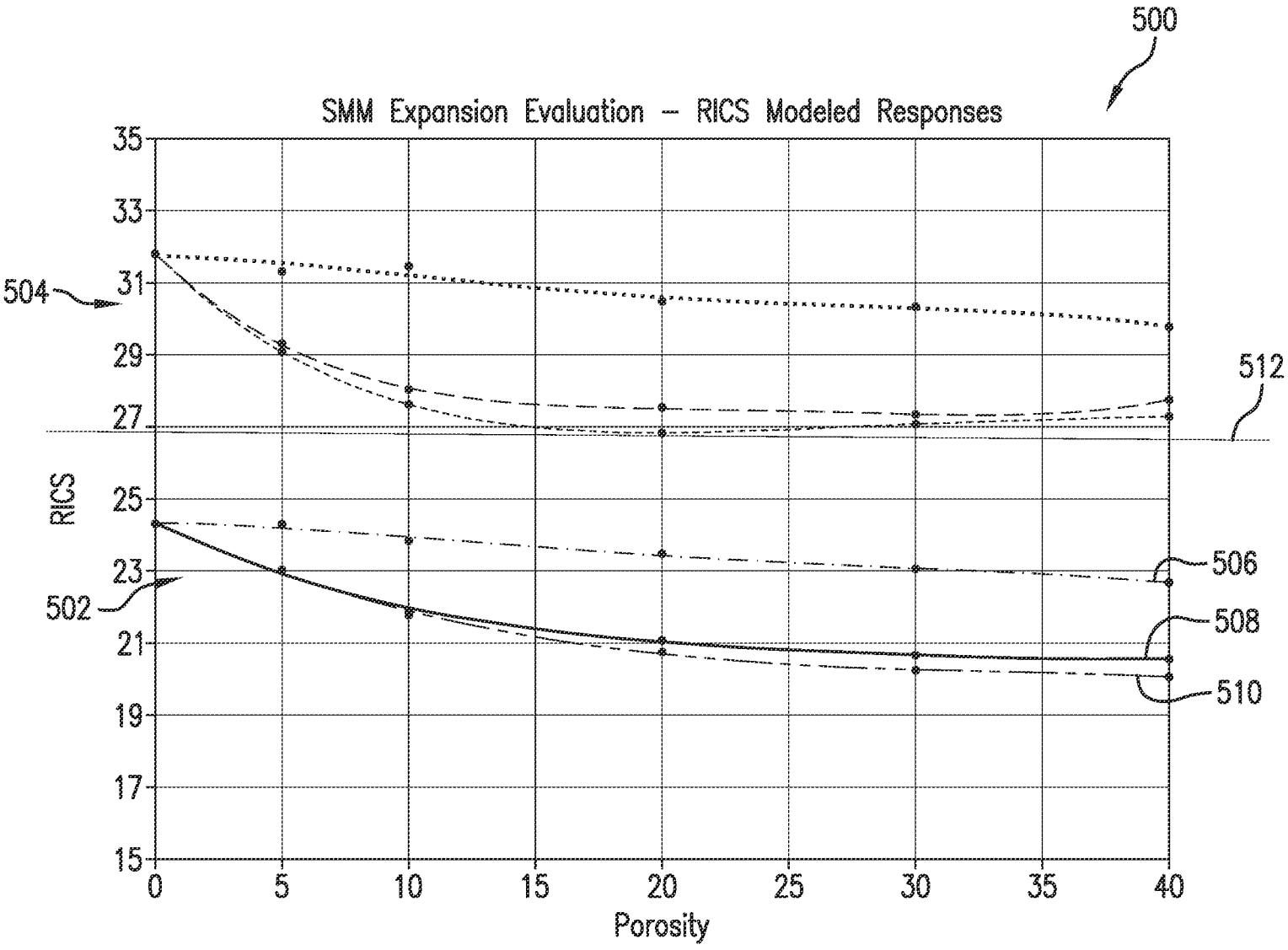
FIG. 5 shows a graph of modeled RICS responses for different borehole conditions.

FIG. 5 shows a graph 500 of modeled RICS responses for different borehole conditions. Porosity is shown along the abscissa and ratio is shown along the ordinate axis. A first set 502 of modeled RICS responses predicts measurements made by the PN gamma ray measurement tool 130 in a region of the drill string that does not have any SMM (a blank pipe) with oil inside and outside of the drill string. A second set 504 of modeled RICS responses predicts measurements made by the PN gamma ray measurement tool 130 for an expanded SMM 116. As illustrated in the first set 502 of modeled RICS responses, a first RICS response 506 is obtained with respect to a gas filled formation, a second RICS response 508 is obtained with respect to a water filled formation and a third RICS response 510 is obtained with respect to an oil filled formation. Responses are similar for the second set 504.

The curves of the first set 502 are entirely distinguishable from the curves to the second set 504, with no overlapping between curves from different sets. Thus, it is possible to set a non-ambiguous range of RICS between values indicative of a blank pipe and values indicative of a pipe with SMM in an expanded state, as shown by threshold line 512. The range of RICS values can be determined from by prior testing, simulation, Monte Carlo modeling (such as a Monte Carlo N-Particle modeling) or using in-situ reference measurements. While FIG. 5 is a graph of RICS, similarly graphs can be formed for other measurement ratios, including RTCS.

Figure 6:
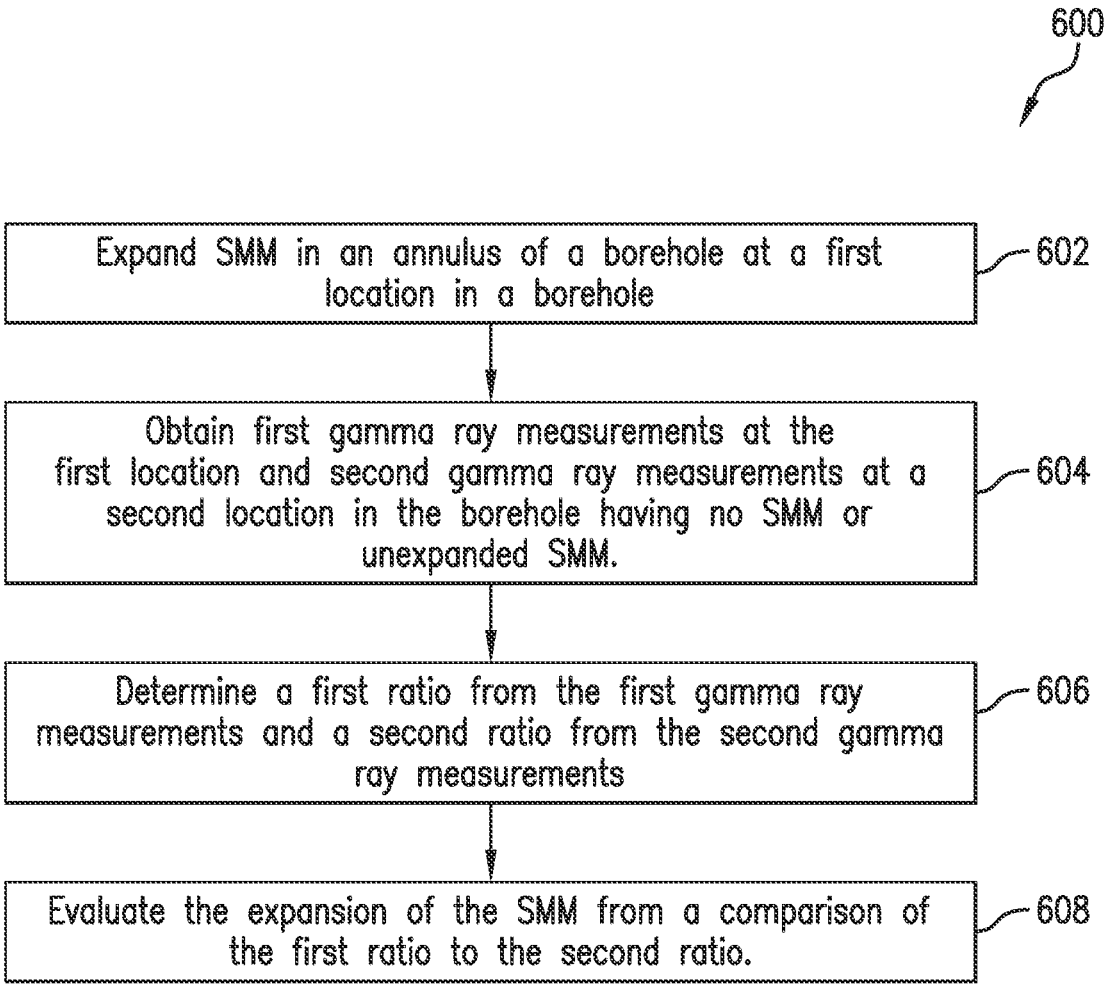
FIG. 6 is a flowchart of a method of evaluating the expansion of the shape memory material into the annulus, in another embodiment.

FIG. 6 is a flowchart 600 of a method of evaluating the expansion of the SMM into the annulus 112, in another embodiment. In box 602, the SMM is expanded at a first location in the borehole 104. In box 604, a first set of inelastic PN gamma ray measurements and capture PN gamma ray measurements are obtained at the first location and a second set of inelastic PN gamma ray measurements and capture PN gamma ray measurements at a second location. The second location is an in-situ calibration location or reference location in which no SMM has been placed or which has been left unfilled. Alternatively, there can be SMM at the second location, but in an unexpanded state. In box 606, a first ratio (first RICS measurement) is determined for the first location from inelastic PN gamma ray measurements and the capture PN gamma ray measurements obtained at the first location and a second ratio (second RICS measurement) is determined for the second location from inelastic PN gamma ray measurements and capture PN gamma ray measurements obtained at the second location. In 608, the first RICS measurement is compared to the second RICS measurement. The expansion of the SMM at the first location is evaluated from a comparison of the first RICS measurement to the second RICS measurement. When a difference between the first RICS measurement and the second RICS measurement is greater than a selected criterion, the expansion of the SMM into the annulus at the first location is considered to be complete or sufficient. In an alternative embodiment, the method can be performed using an RTCS or a suitable ratio of a quantity including inelastic gamma rays to a quantity of capture gamma rays.

Set forth below are some embodiments of the foregoing disclosure:

Embodiment 1. A method of evaluating an expansion of a shape memory material (SMM) in a borehole includes expanding the SMM into the borehole at a first location, obtaining inelastic gamma ray measurements and capture gamma ray measurements from the borehole at the first location using a pulsed neutron gamma ray tool, estimating a ratio of a first quantity including at least the inelastic gamma ray measurements to a second quantity including the capture gamma ray measurements, at the first location, and evaluating a degree to which the SMM has filled the borehole at the first location based on a relation between the ratio and a selected range.

Embodiment 2: The method of any prior embodiment, further comprising running the pulsed neutron gamma ray tool through the borehole after the SMM has been expanded at the first location.

Embodiment 3: The method of any prior embodiment, wherein the selected range is determined using at least one of: (i) laboratory testing; (ii) a simulation; (iii) a model; (iv) a Monte Carlo model; and (v) testing at an in-situ reference location.

Embodiment 4: The method of any prior embodiment, further comprising obtaining a first set of inelastic gamma ray measurements and capture gamma ray measurements at the first location that includes the SMM in an expanded state and a second set of inelastic gamma ray measurements and capture gamma ray measurements at a second location that is without the SMM or in which the SMM is present in an unexpanded state, estimating a first ratio including at least the first inelastic gamma ray measurements and the first capture gamma ray measurements for the first location and a second ratio including at least the second inelastic gamma ray measurements and the second capture gamma ray measurements for the second location, and evaluating the expansion of the SMM at the first location based on a difference between the first ratio and the second ratio.

Embodiment 5: The method of any prior embodiment, wherein evaluating the expansion further comprises evaluating the expansion of the SMM into an annulus of the borehole.

Embodiment 6: The method of any prior embodiment, further comprising at least one of: (i) comparing the ratio with a select range of a modeled ratio response to quantitatively estimate the degree to which the SMM has filled the borehole; and (ii) comparing the ratio to a threshold to estimate the degree to which the SMM has filled the borehole.

Embodiment 7: The method of any prior embodiment, further comprising at least one of: (i) recommending a production operation when an amount of an annulus filled by the SMM meets a criterion; (ii) recommending an injection operation when the amount of the annulus filled by the SMM meets the criterion; (iii) recommending a storage operation when the amount of the annulus filled by the SMM meets the criterion; (iv) recommending a completion operation when the amount of the annulus filled by the SMM meets the criterion; and (v) recommending a remedial action when the amount of the annulus filled by the SMM does not meet the criterion.

Embodiment 8: The method of any prior embodiment, wherein the ratio is at least one of: (i) a ratio of the inelastic gamma ray measurements to the capture gamma ray measurements (RICS); and (ii) a ratio of total gamma ray measurements to capture gamma ray measurements.

Embodiment 9. A downhole system, including a work string forming an annulus with a borehole, a shape memory material (SMM) configured to expand into the annulus, a pulsed neutron gamma ray tool configured to irradiate the borehole and formation with neutrons and detect gamma rays generated from the borehole in response to the irradiation, and a processor. The processor is configured to receive inelastic gamma ray measurements and capture gamma ray measurements based on irradiating the borehole at a first location within the borehole after the SMM has been expanded into the annulus at the first location, estimates a ratio of a first quantity including at least the inelastic gamma ray measurements to a second quantity including the capture gamma ray measurements, at the first location, and evaluates a degree to which the SMM has filled the borehole at the first location based on a relation between the ratio and a selected range.

Embodiment 10: The downhole system of any prior embodiment, wherein the pulsed neutron gamma ray tool is configured to be run through the work string after the SMM has been expanded into the annulus.

Embodiment 11: The downhole system of any prior embodiment, wherein the selected range is determined using at least one of: (i) laboratory testing; (ii) a simulation; (iii) a model; (iv) a Monte Carlo model; and (v) testing at an in-situ reference location.

Embodiment 12: The downhole system of any prior embodiment, wherein the pulsed neutron gamma ray tool is configured to be run between a first location including the SMM in an expanded state and a second location without SMM or in which SMM is present in an unexpanded state, and the processor is further configured to obtain a first set of inelastic gamma ray measurements and capture gamma ray measurements at the first location and a second set of inelastic gamma ray measurements and capture gamma ray measurements at the second location, estimate a ratio of a first quantity including at least the inelastic gamma ray measurements to a second quantity including the capture gamma ray measurements, at the location, and evaluate a degree to which the SMM has filled the borehole at the location based on a relation between the ratio measurement and a selected range.

Embodiment 13: The downhole system of any prior embodiment, wherein the processor is further configured to evaluate the expansion of the SMM into the annulus.

Embodiment 14: The downhole system of any prior embodiment, wherein the processor is further configured to perform at least one of: (i) comparing the ratio with a selected range of the modeled ratio response to quantitatively estimate the degree to which the SMM has filled the borehole; and (ii) comparing the ratio to a threshold to estimate the degree to which the SMM has filled the borehole.

Embodiment 15: The downhole system of any prior embodiment, wherein the processor is further configured to recommend at least one of: (i) a production operation when an amount of the annulus filled by the SMM meets a criterion; (ii) an injection operation when the amount of the annulus filled by the SMM meets the criterion; (iii) a storage operation when the amount of the annulus filled by the SMM meets the criterion; (iv) a completion operation when the amount of the annulus filled by the SMM meets the criterion; and (v) a remedial action when the amount of the annulus filled by the SMM does not meet the criterion.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of evaluating an expansion of a shape memory material (SMM) in a borehole, comprising:

expanding the SMM into the borehole at a first location;

obtaining inelastic gamma ray measurements and capture gamma ray measurements from the borehole at the first location using a pulsed neutron gamma ray tool;

estimating a ratio of a first quantity including at least the inelastic gamma ray measurements to a second quantity including the capture gamma ray measurements, at the first location; and evaluating a degree to which the SMM has filled the borehole at the first location based on a relation between the ratio and a selected range determined using a Monte Carlo model.

2. The method of claim 1, further comprising running the pulsed neutron gamma ray tool through the borehole after the SMM has been expanded at the first location.

3. The method of claim 1, further comprising obtaining a first set of inelastic gamma ray measurements and capture gamma ray measurements at the first location that includes the SMM in an expanded state and a second set of inelastic gamma ray measurements and capture gamma ray measurements at a second location that is without the SMM or in which the SMM is present in an unexpanded state, estimating a first ratio including at least the first inelastic gamma ray measurements and the first capture gamma ray measurements for the first location and a second ratio including at least the second inelastic gamma ray measurements and the second capture gamma ray measurements for the second location, and evaluating the expansion of the SMM at the first location based on a difference between the first ratio and the second ratio.

4. The method of claim 1, wherein evaluating the expansion further comprises evaluating the expansion of the SMM into an annulus of the borehole.

5. The method of claim 1, further comprising at least one of: (i) comparing the ratio with a select range of a modeled ratio response to quantitatively estimate the degree to which the SMM has filled the borehole; and (ii) comparing the ratio to a threshold to estimate the degree to which the SMM has filled the borehole.

6. The method of claim 1, further comprising at least one of: (i) recommending a production operation when an amount of an annulus filled by the SMM meets a criterion; (ii) recommending an injection operation when the amount of the annulus filled by the SMM meets the criterion; (iii) recommending a storage operation when the amount of the annulus filled by the SMM meets the criterion; (iv) recommending a completion operation when the amount of the annulus filled by the SMM meets the criterion; and (v) recommending a remedial action when the amount of the annulus filled by the SMM does not meet the criterion.

7. The method of claim 1, wherein the ratio is at least one of: (i) a ratio of the inelastic gamma ray measurements to the capture gamma ray measurements (RICS); and (ii) a ratio of total gamma ray measurements to capture gamma ray measurements.

8. A downhole system, comprising:

a work string forming an annulus with a borehole;

a shape memory material (SMM) configured to expand into the annulus;

a pulsed neutron gamma ray tool configured to irradiate the borehole and formation with neutrons and detect gamma rays generated from the borehole in response to the irradiation; and a processor configured to:

receive inelastic gamma ray measurements and capture gamma ray measurements based on irradiating the borehole at a first location within the borehole after the SMM has been expanded into the annulus at the first location;

estimates a ratio of a first quantity including at least the inelastic gamma ray measurements to a second quantity including the capture gamma ray measurements, at the first location; and evaluates a degree to which the SMM has filled the borehole at the first location based on a relation between the ratio and a selected range determined using a Monte Carlo model.

9. The downhole system of claim 8, wherein the pulsed neutron gamma ray tool is configured to be run through the work string after the SMM has been expanded into the annulus.

10. The downhole system of claim 8, wherein the pulsed neutron gamma ray tool is configured to be run between a first location including the SMM in an expanded state and a second location without SMM or in which SMM is present in an unexpanded state, and the processor is further configured to:

obtain a first set of inelastic gamma ray measurements and capture gamma ray measurements at the first location and a second set of inelastic gamma ray measurements and capture gamma ray measurements at the second location;

estimate a first ratio including at least the first inelastic gamma ray measurements and the first capture gamma ray measurements for the first location and a second ratio including at least the second inelastic gamma ray measurements and the second capture gamma ray measurements for the second location; and evaluate the expansion of the SMM at the first location based on a difference between the first ratio and the second ratio.

11. The downhole system of claim 8, wherein the processor is further configured to evaluate the expansion of the SMM into the annulus.

12. The downhole system of claim 8, wherein the processor is further configured to perform at least one of: (i) comparing the ratio with a selected range of the modeled ratio response to quantitatively estimate the degree to which the SMM has filled the borehole; and (ii) comparing the ratio to a threshold to estimate the degree to which the SMM has filled the borehole.

13. The downhole system of claim 8, wherein the processor is further configured to recommend at least one of: (i) a production operation when an amount of the annulus filled by the SMM meets a criterion; (ii) an injection operation when the amount of the annulus filled by the SMM meets the criterion; (iii) a storage operation when the amount of the annulus filled by the SMM meets the criterion; (iv) a completion operation when the amount of the annulus filled by the SMM meets the criterion; and (v) a remedial action when the amount of the annulus filled by the SMM does not meet the criterion.

* * * * *